US008225950B2

(12) United States Patent
Fukai

(10) Patent No.: US 8,225,950 B2
(45) Date of Patent: Jul. 24, 2012

(54) FRUIT HOLDER

(75) Inventor: Brian Fukai, Los Angeles, CA (US)

(73) Assignee: LeTube Custom Cigar Tubes, LLC, Los Angeles, CA (US)

( * ) Notice: Subject to any disclaimer, the term of this patent is extended or adjusted under 35 U.S.C. 154(b) by 296 days.

(21) Appl. No.: 12/589,278

(22) Filed: Oct. 21, 2009

(65) Prior Publication Data

US 2011/0089136 A1 Apr. 21, 2011

(51) Int. Cl.

| | |
|---|---|
| ***B65D 23/12*** | (2006.01) |
| ***B67B 7/44*** | (2006.01) |
| ***A47J 19/02*** | (2006.01) |
| ***B67C 11/02*** | (2006.01) |

(52) U.S. Cl. ..... 215/386; 81/3.09; 99/508; 141/337

(58) Field of Classification Search ..... 215/386; 99/508; 100/133–135; 141/331, 332, 337; 81/3.09; 7/110, 151

See application file for complete search history.

(56) References Cited

U.S. PATENT DOCUMENTS

| | | | | | |
|---|---|---|---|---|---|
| 170,888 | A | * | 12/1875 | Noble | 7/110 |
| 562,125 | A | * | 6/1896 | Dummer | 99/508 |
| 564,595 | A | * | 7/1896 | Cunningham | 241/95 |
| 870,124 | A | * | 11/1907 | Persen | 99/508 |
| 992,667 | A | * | 5/1911 | Kandlbinder | 99/508 |
| 1,416,101 | A | * | 5/1922 | Little | 141/333 |
| 1,861,426 | A | | 5/1932 | David et al. | |
| 2,079,193 | A | | 5/1937 | Wigen | |
| 2,327,077 | A | | 8/1943 | Teetor | |
| 2,370,931 | A | | 3/1945 | Bogin et al. | |
| 2,411,384 | A | * | 11/1946 | Miller et al. | 73/61.41 |
| D172,571 | S | * | 7/1954 | Ward | D9/436 |
| 2,781,069 | A | * | 2/1957 | Byrd | 99/508 |
| 2,812,784 | A | * | 11/1957 | Palmer | 141/98 |
| 3,021,977 | A | | 2/1962 | Hester | |
| 3,464,344 | A | | 9/1969 | Hawthorne | |
| 3,602,396 | A | * | 8/1971 | Oates | 222/88 |
| D251,405 | S | | 3/1979 | Ackeret | |
| 4,334,557 | A | * | 6/1982 | YaSenka | 141/98 |
| 4,433,597 | A | * | 2/1984 | Rowland | 81/3.09 |
| D282,807 | S | * | 3/1986 | Hasse | D7/700 |
| 4,598,435 | A | * | 7/1986 | Borodulin et al. | 7/156 |
| 5,647,415 | A | * | 7/1997 | Onders et al. | 141/331 |
| 5,727,321 | A | | 3/1998 | Lewis | |
| 5,782,276 | A | * | 7/1998 | Kilgore | 141/332 |
| D409,747 | S | | 5/1999 | Aiken | |

(Continued)

FOREIGN PATENT DOCUMENTS

CN 201641528 U * 11/2010

*Primary Examiner* — Sue Weaver

(74) *Attorney, Agent, or Firm* — Arthur W. Fisher, III; David W. Pettis, Jr.

(57) ABSTRACT

A fruit holder for removable attachment to the top of an open bottle such as, for example, an open beer bottle. The fruit holder is characterized by its construction including a bottle top engaging portion in fluid communicating relation to a beverage contained by the bottle, a funnel portion integrally formed above the bottle top engaging portion, and a wedge holder integrally formed on a segment of the funnel and extending outwardly from the funnel so that a fruit wedge may be placed and held on the wedge holder and juice from the fruit wedge, when squeezed, will flow along the wedge holder into the funnel, and through the bottle top engaging portion to the beverage contained by the bottle.

5 Claims, 5 Drawing Sheets

U.S. PATENT DOCUMENTS 6,056,206 A 5/2000 Whiton
6,425,424 B1 * 7/2002 Calvo et al. ..... 141/331
6,550,271 B2 4/2003 Silbert
D488,226 S * 4/2004 MacDonald et al. ..... D24/122
7,698,767 B2 * 4/2010 Clark, Jr. ..... 7/155
2008/0053566 A1 * 3/2008 England ..... 141/331
2008/0245190 A1 * 10/2008 Sarazin ..... 81/3.09
2010/0084042 A1 * 4/2010 Bonnell ..... 141/1

* cited by examiner

FRUIT HOLDER

BACKGROUND OF THE INVENTION

1. Field of the Invention

The present invention relates to a fruit holder constructed for removable attachment to the open top of a bottle such as, for example, a beer bottle. The fruit holder includes a wedge holder integrally formed thereon whereby a fruit wedge such as, for example, lime may be placed on the wedge holder even while the invention is attached to the bottle. Juice squeezed onto the wedge holder may drain through the invention into the open bottle to mix with the beverage contained therein. Four (4) preferred embodiments are disclosed and claimed hereinafter.

2. Description of the Prior Art

It is well known that many persons enjoy the taste provided by the addition of a fruit flavor to a wide variety of beverages. Such beverages may include a broad range of products such as, for example, water, tea, soft drinks, beer, wine, and even mixed alcoholic cocktails. Perhaps best recognized by many people is the addition of lime juice to beer, as a result of extensive advertisements distributed by a Mexican beer producer. However, as those advertisements illustrate, the current method for introducing the lime juice into the beer is by lodging a lime wedge into the open top of the beer bottle. The consumer then removes the wedge and squeezes it over the open bottle so that at least some of the juice goes into the bottle. The consumer then typically forces the squeezed lime wedge through the open bottle so that it drops into the beer. Of course a similar operation can be performed with virtually any beverage contained within a bottle-type container. Also obvious is the fact that it is relatively difficult for the consumer to ensure that all of the juice, or even most of the juice, actually finds its way to the intended beverage. Almost without exception, a significant quantity of juice spills down the side of the bottle.

Clearly, there is a need in the art for a device that will not only present a fruit segment with an opened bottled beverage, but also will provide a construction whereby virtually all of the juice squeezed from the fruit section will actually flow into the beverage contained within the bottle. Such a device must engage the open bottle so that the juice may flow therethrough into the beverage, but such a device must also be removable from the bottle so that the consumer may enjoy the beverage into which the juice has been introduced. For purposes of sanitation, any such device must be constructed from a material that can be thoroughly cleaned and should preferably be of unitary construction so that no joints, cracks, nor crevices are present to provide an environment for the growth of bacteria.

SUMMARY OF THE INVENTION

The present invention relates to a fruit holder that is removably attachable to the open top of a bottle. The fruit holder comprises a bottle top engaging segment defined by a hollow cylinder having an inside diameter, an outside diameter, a bottom edge and a top. Integrally formed on the top of the hollow cylinder is a funnel portion that is in fluid communicating relation to the interior diameter of the hollow cylinder. The funnel portion comprises a funnel wall that extends upwardly away from the top of the hollow cylinder. A wedge holder is integrally formed on a segment of the funnel wall, and the wedge holder extends outwardly from the funnel wall. The wedge holder comprises a top surface, a bottom surface, and a distal end. When attached to an open bottle, a fruit wedge may be placed on the top surface of the wedge holder. When a consumer squeezes the fruit wedge over the holder, the resulting juice flows down the top surface of the holder, into the funnel portion, and through the hollow cylinder into the bottle and any beverage contained therein.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 6:
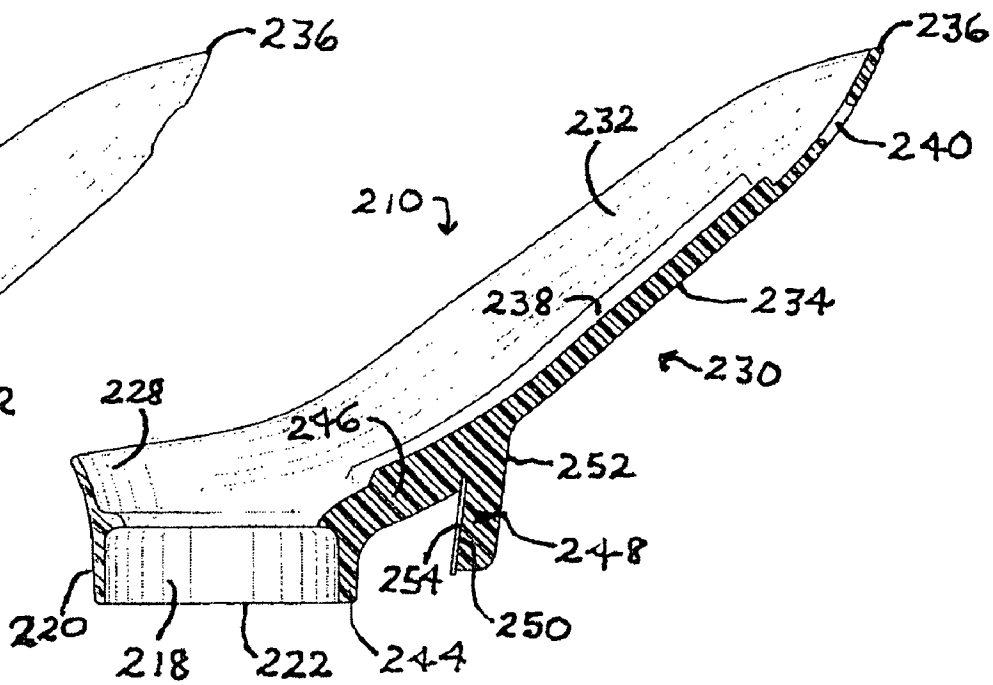
FIG. 6 is a sectional view of the second preferred embodiment as shown in FIG. 5.
Figure 5:
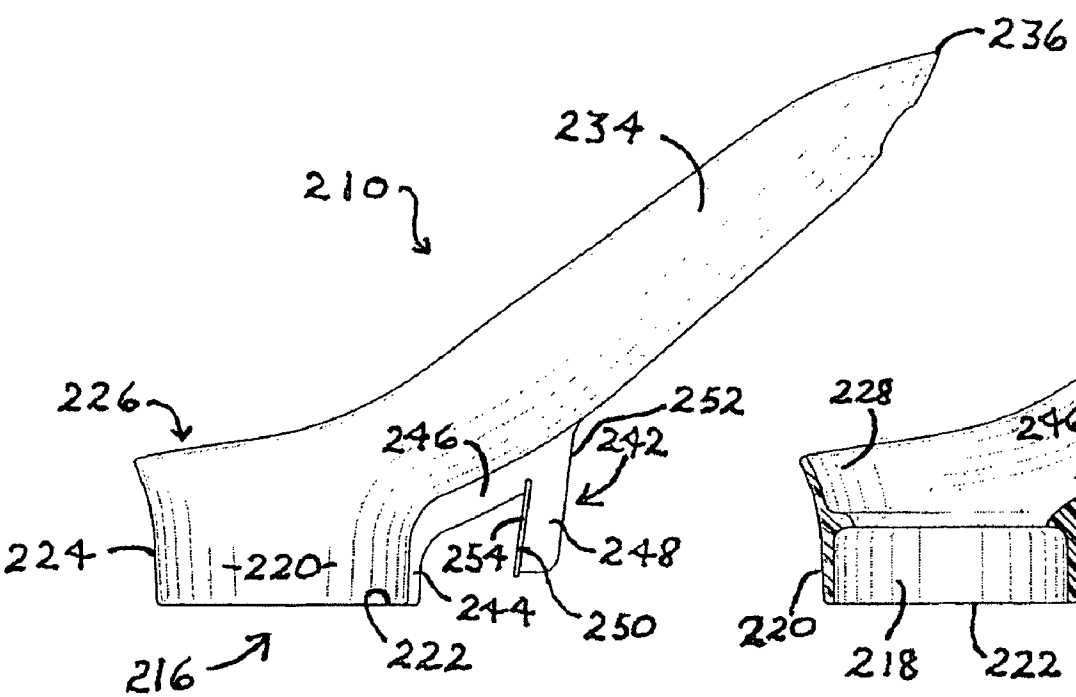
FIG. 5 is a side elevation of a second preferred embodiment of the fruit holder including a crown top opener integrally formed thereon.
Figure 7:
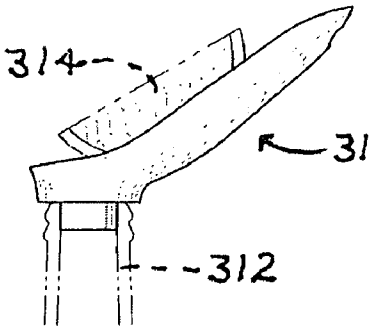
FIG. 7 illustrates a third preferred embodiment of the fruit holder removably attached to the open top of a bottle (shown in phantom) and having a fruit wedge (also shown in phantom) such as, for example, a lime wedge placed thereon.
Figure 8:
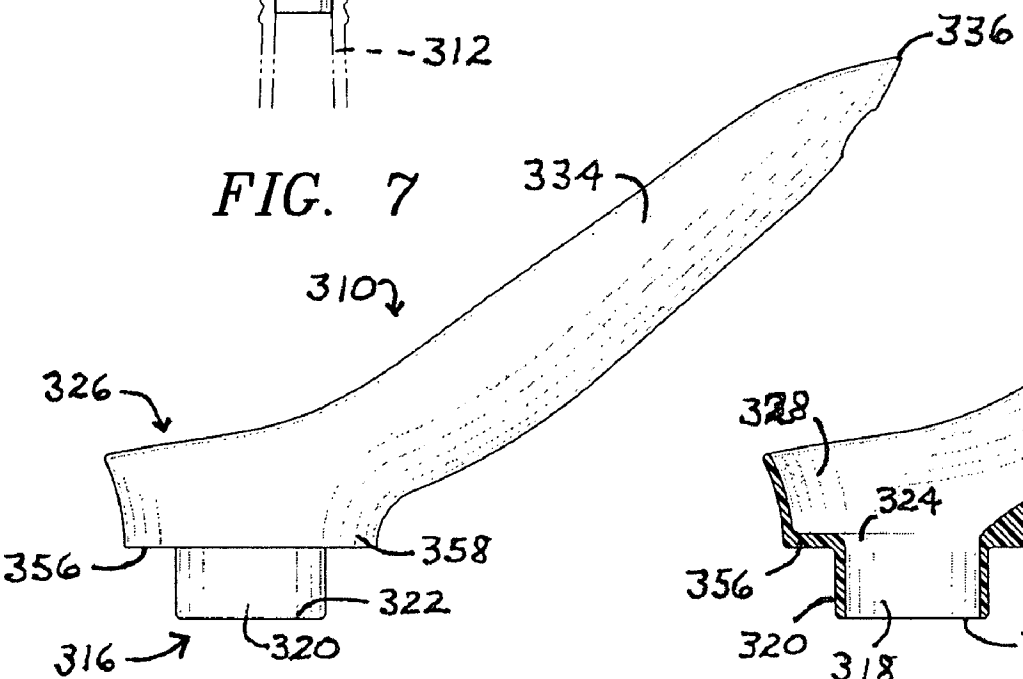
FIG. 8 is a side elevation of the third preferred embodiment shown in FIG. 7.
Figure 9:
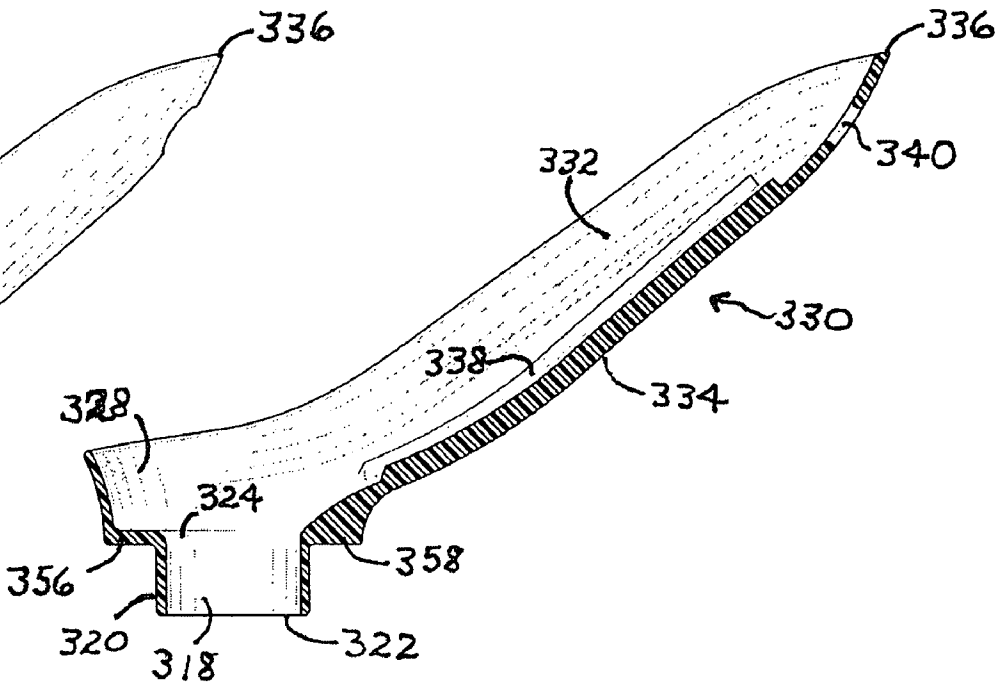
FIG. 9 is a sectional view of the third preferred embodiment as shown in FIG. 8.
Figure 10:
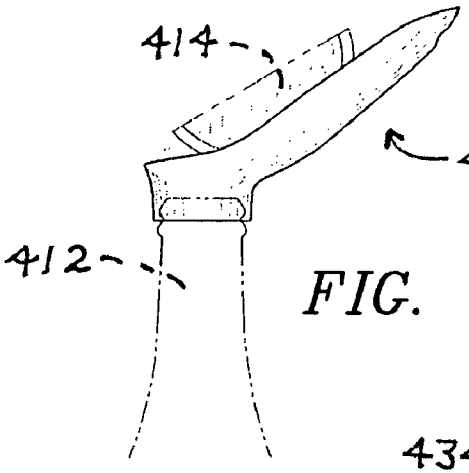
FIG. 10 illustrates a fourth preferred embodiment of the fruit holder removably attached to the open top of a bottle (shown in phantom) and having a fruit wedge (also shown in phantom) such as, for example, a lime wedge placed thereon.
Figure 12:
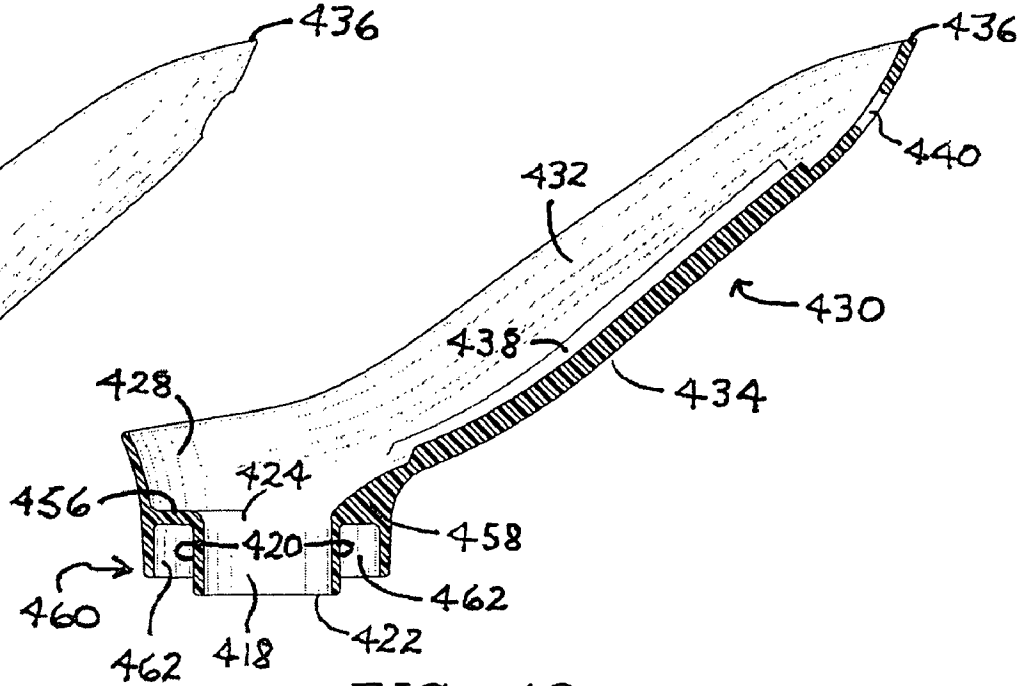
FIG. 12 is a sectional view of the fourth preferred embodiment as shown in FIG. 11.
Figure 11:
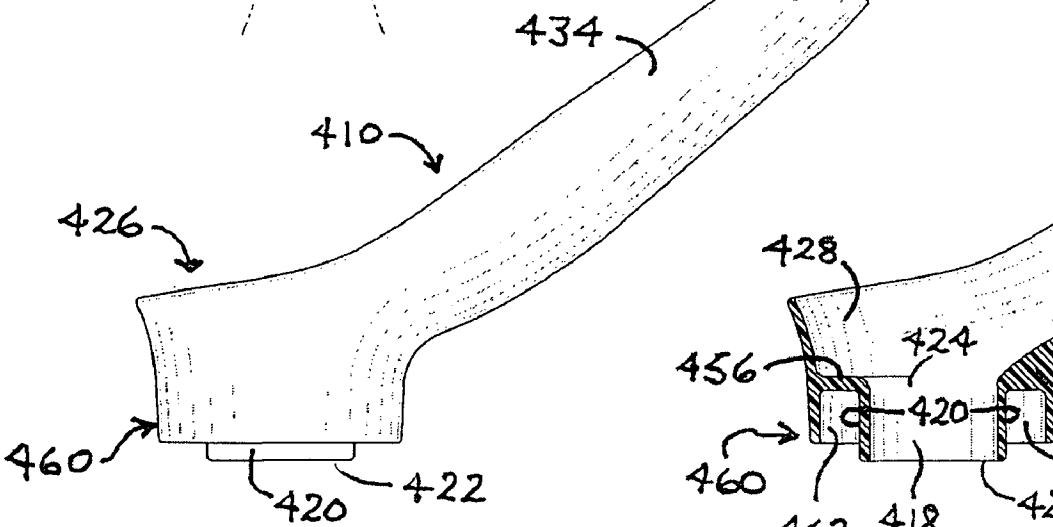
FIG. 11 is a side elevation of the fourth preferred embodiment shown in FIG. 10.

Before providing a detailed description of the preferred embodiments of the present invention, attention is invited to the fact that four (4) preferred embodiments are disclosed. The first preferred embodiment is shown in FIGS. 1-4, and the structural elements are identified by numerals in a 1xx series. The second preferred embodiment is shown in FIGS. 5 & 6, and the structural elements are identified by numerals in a 2xx series. The third preferred embodiment is shown in FIGS. 7-9, and the structural elements are identified by numerals in a 3xx series. The fourth preferred embodiment is shown in FIGS. 10-12, and the structural elements are identified by numerals in a 4xx series. The last two digits of the reference numerals indentify similar parts in each of the four preferred embodiments.

As is more fully described below, all elements of the present invention, with a single exception relating to the second preferred embodiment, are preferably formed as a single piece as by, for example, molding or stamping.

While any suitable material for such manufacturing processes may be used, it is recommended that the invention be molded from a suitable plastic or rubber material. This not only ensures a snug, substantially fluid-tight seal with the open bottle top, but also enhances the ease with which the invention may be cleaned and/or sanitized. It is also to be understood that while the following detailed description is given with regard to a wedge of lime, this is for purposes of explanation and clarity only. The specific fruit chosen is not a limiting factor on the scope of the present invention.

Figure 2:
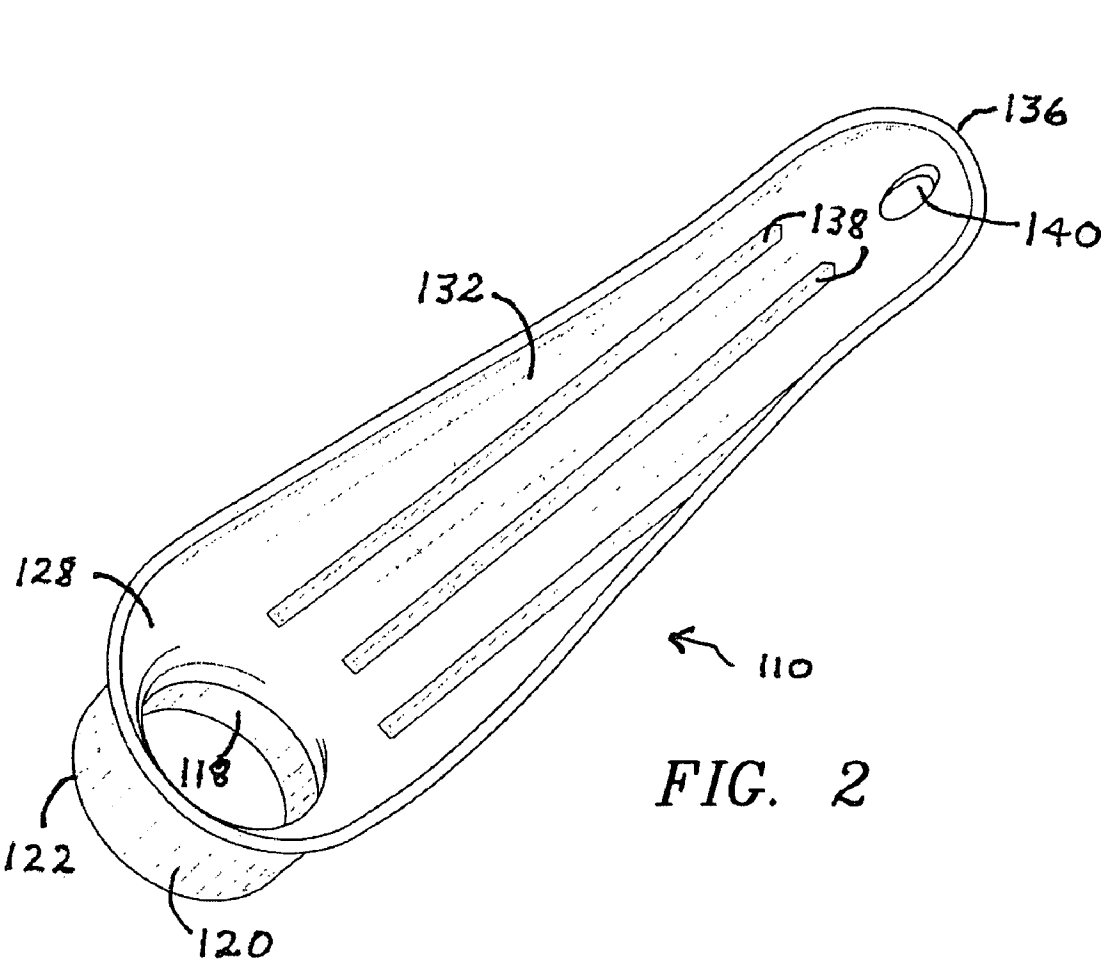
FIG. 2 is a perspective view of the first preferred embodiment shown in FIG. 1.
Figure 1:
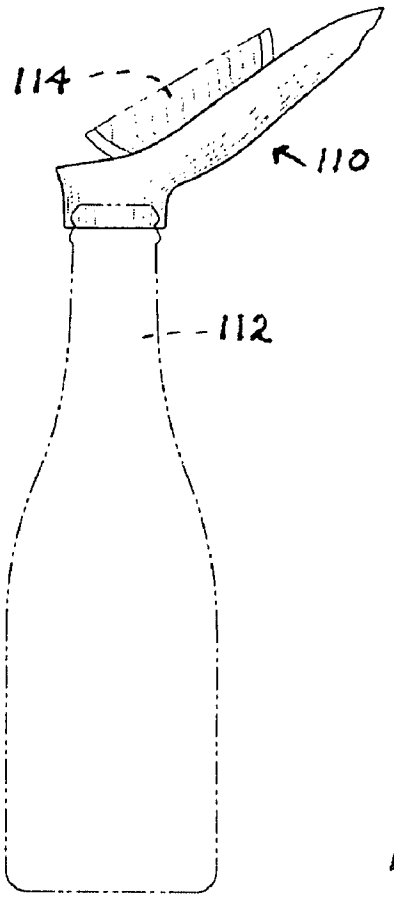
FIG. 1 illustrates a first preferred embodiment of the fruit holder removably attached to the open top of a bottle (shown in phantom) and having a fruit wedge (also shown in phantom) such as, for example, a lime wedge placed thereon.
Figure 4:
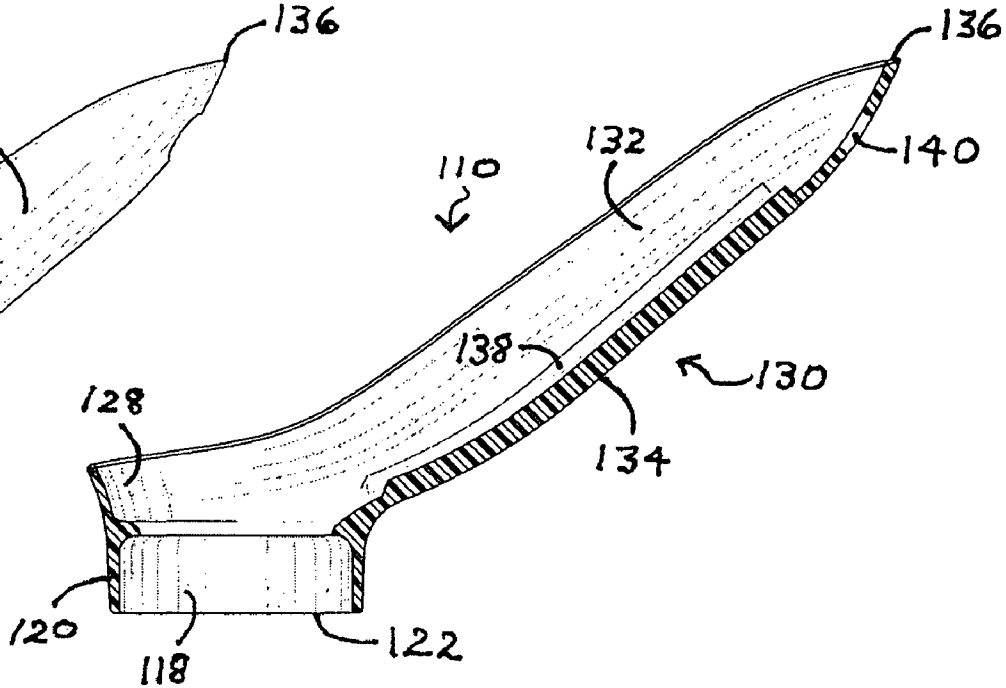
FIG. 4 is a sectional view of the first preferred embodiment as shown in FIG. 3.
Figure 3:
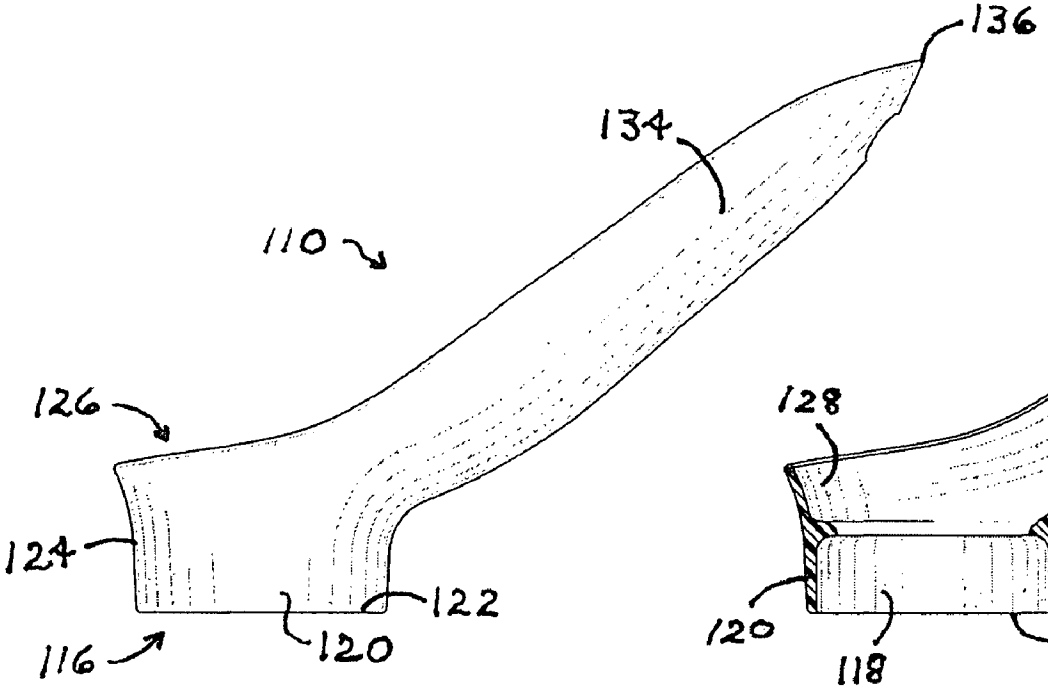
FIG. 3 is a side elevation of the first preferred embodiment shown in FIG. 1.

Attention is now invited to the first preferred embodiment as shown in the views of FIGS. 1-4. The fruit holder is generally indicated as 110. In the view of FIG. 1, fruit holder 110 is illustrated as being operatively attached to the open top of bottle 112, and a wedge of lime 114 is shown as resting on fruit holder 110. FIG. 2 illustrates additional details of fruit holder 110.

Fruit holder 110 includes a bottle top engaging segment defined by a hollow cylinder, generally indicated as 116. The interior diameter of hollow cylinder 116 is defined by inner wall 118, and the outside diameter of hollow cylinder 116 is defined by outer wall 120. Hollow cylinder 116 further includes a bottom edge 122 and a top 124. A funnel portion, generally indicated as 126 is integrally formed on top 124 in fluid communicating relation to the hollow cylinder 116 and comprises funnel wall 128 which extends upwardly away from top 124. Next, a wedge holder, generally indicated as 130, is integrally formed on a segment of funnel wall 128 and extends outwardly from funnel wall 128. Wedge holder 130 comprises a top surface 132, a bottom surface 134, and a distal end 136.

As best seen in the view of FIG. 1, fruit holder 110 is removably attached to the open top of bottle 112 by receiving the open top within the inside diameter of hollow cylinder 116. The inside diameter defined by inner wall 118 is equal to or slightly less than the outside diameter of the bottle top, thereby providing a snug, substantially fluid-tight, removable attachment of the fruit holder 110 to bottle 112. FIG. 1 also shows placement of a wedge of lime 114 onto top surface 132 of wedge holder 130. As a customer squeezes lime wedge 114 over top surface 132, the resulting juice will flow across top surface 132 into funnel portion 126, and then through hollow cylinder 116 into the beverage contained within bottle 112. The customer may then simply remove fruit holder 110 and consume the beverage.

The view of FIG. 2 also shows additional elements which may be included in the construction of fruit holder 110. Formed on top surface 132 is at least one ridge 138, and preferably a plurality of ridges 138. Each ridge 138 serves not only to assist in holding lime wedge 114 on top surface 132, but also will assist drainage of juice toward funnel portion 126. Finally, an aperture 140 may be provided through wedge holder 130 in spaced apart relation to distal end 136. The aperture 140 may be used to hang fruit holder 110 on a rack or pin, or may be used for the attachment of a lanyard or cord so that fruit holder 110 may be worn around the neck of the user.

The second preferred embodiment of the fruit holder is generally indicated as 210 in the views of FIGS. 5 and 6. Specifically, the fruit holder is generally indicated as 210.

Fruit holder 210 includes a bottle top engaging segment defined by a hollow cylinder, generally indicated as 216. The interior diameter of hollow cylinder 216 is defined by inner wall 218, and the outside diameter of hollow cylinder 216 is defined by outer wall 220. Hollow cylinder 216 further includes a bottom edge 222 and a top 224. A funnel portion, generally indicated as 226 is integrally formed on top 224 in fluid communicating relation to the hollow cylinder 216 and comprises funnel wall 228 which extends upwardly away from top 224. Next, a wedge holder, generally indicated as 230, is integrally formed on a segment of funnel wall 228 and extends outwardly from funnel wall 228. Wedge holder 230 comprises a top surface 232, a bottom surface 234, and a distal end 236. Formed on top surface 232 is at least one ridge 238, and preferably a plurality of ridges 238. Each ridge 238 serves not only to assist in holding lime wedge 214 on top surface 232, but also will assist drainage of juice toward funnel portion 226. Finally, an aperture 240 may be provided through wedge holder 230 in spaced apart relation to distal end 236. The aperture 240 may be used to hang fruit holder 210 on a rack or pin, or may be used for the attachment of a lanyard or cord so that fruit holder 210 may be worn around the neck of the user. The structural elements of fruit holder 210 are the same as those of fruit holder 110 with one addition. As clearly shown in FIGS. 5 and 6, fruit holder 210 further comprises a crown top opener, generally indicated as 242, which may be used to remove a crown cap such as is typically used to seal beverages contained in glass bottles. As shown in FIG. 5, crown top opener 242 is integrally formed on outer wall 220 and on bottom surface 234. Crown top opener comprises a first opener leg defined by an integral first raised segment 244 of outer wall 220, an integral second raised segment 246 of bottom surface 234, and an integral crown engaging leg 248 extending downwardly from the second raised segment 246. Crown engaging leg 248 includes an interior surface 250 that is spaced apart from first raised segment 244 and an exterior surface 252 that extends upwardly to join bottom surface 234. Also as shown in FIGS. 5 and 6, crown top opener 242 may further comprise a reinforcing plate 254 attached to interior surface 250. While the use of reinforcing plate 254 is generally preferred, it may be omitted if the material from which fruit holder 210 is formed is of sufficient strength and rigidity.

All of the structural elements of the third preferred embodiment for fruit holder 310 are the same as those found in fruit holder 110 but for a single modification. Specifically, the fruit holder is generally indicated as 310. Fruit holder 310 is illustrated as being operatively attached to the open top of bottle 312, and a wedge of lime 314.

The fruit holder 310 includes a bottle top engaging segment defined by a hollow cylinder, generally indicated as 316. The interior diameter of hollow cylinder 316 is defined by inner wall 318, and the outside diameter of hollow cylinder 316 is defined by outer wall 320. Hollow cylinder 316 further includes a bottom edge 322 and a top 324. A funnel portion, generally indicated as 326 is integrally formed on top 324 in fluid communicating relation to the hollow cylinder 316 and comprises funnel wall 328 which extends upwardly away from top 324. Next, a wedge holder, generally indicated as 330, is integrally formed on a segment of funnel wall 328 and extends outwardly from funnel wall 328. Wedge holder 330 comprises a top surface 332, a bottom surface 334, and a distal end 336. Formed on top surface 332 is at least one ridge 338, and preferably a plurality of ridges 338. Each ridge 338 serves not only to assist in holding lime wedge 314 on top surface 332, but also will assist drainage of juice toward funnel portion 326. Finally, an aperture 340 may be provided through wedge holder 330 in spaced apart relation to distal end 336. The aperture 340 may be used to hang fruit holder 310 on a rack or pin, or may be used for the attachment of a lanyard or cord so that fruit holder 310 may be worn around the neck of the user.

As clearly shown in the views of FIGS. 7-9, the outside diameter defined by outer wall 320 of hollow cylinder 316 is dimensioned and configured to fit within the open top of bottle 312. As a result of this modification, top 324 includes a lip 356 from which funnel portion 326 extends and a thickened base 358 for bottom surface 334 adjacent funnel portion 326.

Turning to the views of FIGS. 10-12, the fourth preferred embodiment of fruit holder 410 is the same as that of fruit holder 310 with a single addition. The fruit holder 410 is illustrated as being operatively attached to the open top of bottle 412, and a wedge of lime 414 is shown as resting on fruit holder 410.

Fruit holder 410 includes a bottle top engaging segment defined by a hollow cylinder. The interior diameter of the hollow cylinder is defined by inner wall 418, and the outside diameter of hollow cylinder is defined by outer wall 420. Hollow cylinder further includes a bottom edge 422 and a top 424. A funnel portion, generally indicated as 426 is integrally formed on top 424 in fluid communicating relation to the hollow cylinder and comprises funnel wall 428 which extends upwardly away from top 424. Next, a wedge holder, generally indicated as 430, is integrally formed on a segment of funnel wall 428 and extends outwardly from funnel wall 428. Wedge holder 430 comprises a top surface 432, a bottom surface 434, and a distal end 436. Formed on top surface 432 is at least one ridge 438, and preferably a plurality of ridges 438. Each ridge 438 serves not only to assist in holding lime wedge 414 on top surface 432, but also will assist drainage of juice toward funnel portion 426. Finally, an aperture 440 may be provided through wedge holder 430 in spaced apart relation to distal end 436. The aperture 440 may be used to hang fruit holder 410 on a rack or pin, or may be used for the attachment of a lanyard or cord so that fruit holder 410 may be worn around the neck of the user.

Fruit holder 410 further comprises a bottle ring, generally indicated as 460, integrally formed on the funnel portion 426 and the thickened base 458 extending downwardly toward the bottom edge 422 to define an interior bottle ring wall 462 in substantially concentric spaced apart relation to outer wall 420. The space between interior bottle ring wall 462 and outer wall 420 is dimensioned and configured to receive the top of bottle 410 therein.

It is also to be noted that in all four preferred embodiments of this invention, the wedge holders 130, 230, 330, and 430 each not only extend outwardly but also upwardly in order to promote the passage of juice into the beverage contained within each respective bottle 112, 212, 312, and 412.

It will thus be seen that the objects set forth above, among those made apparent from the preceding description, are efficiently obtained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A fruit holder removably attachable to the open top of a bottle, said fruit holder comprising: a bottle top engaging segment defined by a hollow cylinder having an inside diameter, an outside diameter, a bottom edge and a top; a funnel portion formed on said top of said hollow cylinder in fluid communicating relation to said inside diameter, said funnel portion comprising a funnel wall extending upwardly away from said top of said hollow cylinder; and a wedge holder formed on a segment of said funnel wall, said wedge holder extending outwardly from said segment of said funnel wall, said wedge holder comprising a top surface, a bottom surface, and a distal end, whereby a fruit wedge may be placed and held on said wedge holder top surface and juice from the fruit wedge, when squeezed, will flow into said funnel segment, through said inside diameter, and into the bottle and a crown top opener formed on said outside diameter of said hollow cylinder and on said bottom surface of said wedge holder, said crown top opener comprising a first opener leg comprising a first raised segment of said outside diameter of said bottle top engaging portion, a second raised segment of said bottom surface of said wedge holder, and a crown engaging leg extending downwardly from said second raised segment of said bottom surface of said wedge holder, said crown engaging leg comprising an interior surface spaced apart from said first raised segment and an exterior surface extending upwardly to join said bottom surface of said wedge holder and wherein said inside diameter of said hollow cylinder is dimensioned to receive the open top of the bottle therein whereby said fruit holder is removably attached to the bottle.

2. A fruit holder as in claim 1 wherein said crown top holder further comprises a reinforcing plate attached to said interior surface of said crown engaging leg.

3. A fruit holder as in claim 1 wherein said wedge holder top surface comprises at least one ridge formed thereon and extending along said wedge holder top surface from said funnel wall toward said wedge holder distal end.

4. A fruit holder as in claim 1 further comprising an aperture formed through said wedge holder in spaced apart relation to said wedge holder distal end.

5. A fruit holder as in claim 1 wherein said wedge holder extends diagonally upward from said segment of said funnel wall.

* * * * *